US006788214B2

(12) United States Patent
Lelecas

(10) Patent No.: US 6,788,214 B2
(45) Date of Patent: Sep. 7, 2004

(54) POWER OUTAGE ALERT ELECTRONIC DEVICE

(76) Inventor: Michael Lelecas, 51 Bayberry La., South Burlington, VT (US) 05403

( * ) Notice: Subject to any disclaimer, the term of this patent is extended or adjusted under 35 U.S.C. 154(b) by 0 days.

(21) Appl. No.: 10/212,415

(22) Filed: Aug. 5, 2002

(65) Prior Publication Data

US 2004/0021577 A1 Feb. 5, 2004

(51) Int. Cl.[7] ..... G08B 21/00

(52) U.S. Cl. ..... 340/654; 340/638; 340/652; 340/660; 340/661

(58) Field of Search ..... 340/654, 660, 340/661, 662, 652, 638, 657, 765, 784, 870.02, 870.03; 364/483, 569, 143, 145; 379/106.01, 39, 40, 47

(56) References Cited

U.S. PATENT DOCUMENTS

| | | | | |
|---|---|---|---|---|
| 4,075,699 A | | 2/1978 | Schneider et al. | 364/492 |
| 4,361,877 A | | 11/1982 | Dyer et al. | 364/900 |
| 4,400,783 A | | 8/1983 | Locke, Jr. et al. | 364/483 |
| 4,466,074 A | | 8/1984 | Jindrick et al. | 364/569 |
| 4,479,118 A | | 10/1984 | Cole, Jr. | 340/663 |
| 4,584,651 A | | 4/1986 | Carey, Jr. et al. | 364/483 |
| 4,627,000 A | | 12/1986 | Germer | 364/483 |
| 4,999,575 A | * | 3/1991 | Germer | 340/637 |
| 5,216,357 A | * | 6/1993 | Coppola et al. | 364/483 |
| 6,137,868 A | | 10/2000 | Leach | 379/106.01 |
| 6,229,450 B1 | * | 5/2001 | Malmsten | 340/652 |

* cited by examiner

*Primary Examiner*—Jeffery Hofsass
*Assistant Examiner*—Hung Nguyen
(74) *Attorney, Agent, or Firm*—Edwards & Angell, LLP; George W. Hartnell, III

(57) ABSTRACT

Electronic devices that provide notification of and data about power outages. The devices include a voltage input receiver for receiving voltage from a power source; a voltage monitor for monitoring a reference voltage that is received from the power source; a change in voltage detector for detecting a change in the reference voltage with respect to a threshold voltage; a microprocessor; a programmable real-time clock to provide current date and time data; input/output devices for communicating data to the microprocessor; a display to display data transmitted by the microprocessor; and an auxiliary energy power supply that provides power to the device during any power outage. During a power outage, the date and time of the outage are stored and the device is powered by the auxiliary power source. Once power is returned, the date and time of restored power are stored; the duration of the outage is calculated; and the signal indicates that there has been an outage.

13 Claims, 3 Drawing Sheets

POWER OUTAGE ALERT ELECTRONIC DEVICE

FIELD OF INVENTION

The present invention relates to devices for continuous monitoring power delivery from a source to provide an alert that there has been a power outage. More particularly, the present invention relates to power outage devices that are adaptable to a common power outlet, which provide an alert when there has been one or more power outages and, further, which provide information on the outage, e.g., the number of outages and the date, time, and duration of each outage, and the like.

DESCRIPTION OF THE RELATED ART

There has been a long standing need for sophisticated power outage indicators for home use that are versatile, can be manufactured at low cost, and that are easy to install, operate, and maintain. For individuals who travel or are away from home for extended periods of time, it is important for them to know whether, in their absence, power has been interrupted so that these individuals can prepare for, e.g., food spoilage, clocks that display an incorrect time, and the like.

More specifically, there is a need for a reusable power outage indicator that provides a visual display and/or an audible alarm and provides memory storage for a plurality of power outage events. However, devices for detecting power outages for home and business use are known to the art.

For example, U.S. Pat. No. 4,479,118 to Cole, Jr. teaches a power outage indicator for use in locations that are not readily accessible. The power outage indicator of Cole, Jr. uses a liquid crystal display (LCD) cell to provide visual indication that power has been interrupted. More specifically, the LCD cell includes a pair of parallel electrodes between which is located a liquid crystal material. In manufacture, the cell is initially heated and an electric field is provided between the electrodes. As the cell is allowed to cool, the electric field causes the molecules of the liquid crystal material to assume first a homeotropic nematic orientation before the LCD cell reaches a smectic state. When the LCD cell is in a smectic state, the liquid crystal molecules align homeotropically, producing a clear exterior surface.

The Cole, Jr. power outage indicator also includes a current storing capacitor that is connected in series through a switch to the pair of electrodes. The capacitor is in parallel with the source. As long as current flows from the source, the switch is closed. However, when a power outage interrupts the flow of current, the switch is opened and current stored in the capacitor is delivered to the pair of electrodes. The flow of current past the pair of electrodes produces heat, which heats the liquid crystal material above its clearing point temperature. As the current and heat dissipate, the heated liquid crystal material cools. During this cooling process there is no electric field to align the homeotropic layers. As a result, cooling produces a different optical condition.

Problems with the Cole, Jr. power outage indicator include the complexity of the indicator, a lack of memory, e.g., number, time, and duration of the outage, and an involved resetting process.

U.S. Pat. No. 4,466,074 to Jindrick, et al. teaches a power outage timer that can be used in conjunction with a "smart" electronic watt-hour meter to record the duration of a power outage for the purpose of resetting the real-time value stored in the memory of the electronic watt-hour meter. The electronic watt-hour meter includes a microprocessor, a real-time value memory, and a clock signal source.

According to the Jindrick patent, if there is a power outage, an outage timer causes a timing capacitor to discharge. After the outage is over, the time it takes to recharge the timing capacitor is measured. The microprocessor converts the capacitor recharge time to a power outage time using look-up tables and a driver program. The microprocessor then adds the power outage time to the real-time value to correct the time to account for the duration of the power outage.

SUMMARY OF THE INVENTION

Accordingly, there is a need for a reusable power outage indicator that is easy to use, install, and operate; that provides a visual display and audible alarm of any power outage events; and that provides memory storage for a plurality of power outage events to provide the date, time and duration of each power outage event.

In one embodiment, the present invention provides a power outage detection device for alerting users of the number, time, and duration of one or more power outages, the device comprising:

- a voltage input receiver for receiving voltage from a power source;
- a voltage monitor for monitoring a reference voltage that is received from the power source;
- a change in voltage detector for detecting a change in the reference voltage, wherein the change is determined by comparing the reference voltage with a threshold voltage and the change is of sufficient duration to constitute a power outage;
- a microprocessor having a central processing unit;
- a programmable real-time clock that is in communication with the microprocessor to provide current date and time data;
- one or more input/output devices for communicating data to and from the microprocessor, wherein the one or more input/output devices comprises at least one of:
  - a signal that is in communication with the microprocessor to indicate that there has been one or more power outages;
  - a display that is in communication with the microprocessor to display data on demand; and
  - an auxiliary energy power supply that provides power to the device during the one or more power outages until the reference voltage exceeds the threshold voltage;

wherein the microprocessor comprises a plurality of memory that includes read only memory for storing one or more microprocessor driver programs and random access memory for storing power outage data for one or more power outages.

BRIEF DESCRIPTION OF THE DRAWING

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION AND THE PREFERRED EMBODIMENTS THEREOF

Figure 1:
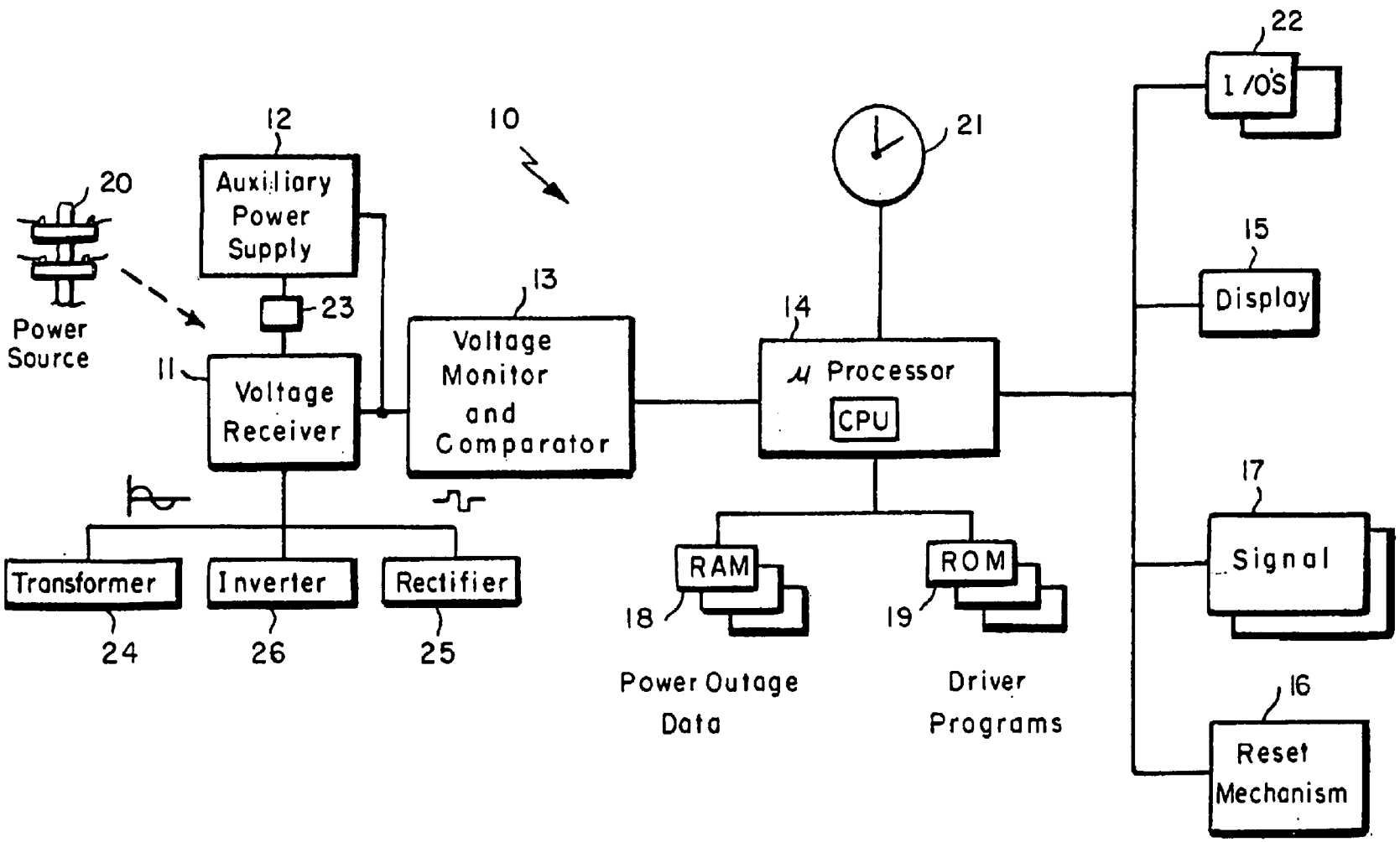
FIG. 1 shows a block diagram of an illustrative embodiment of a power outage indicator in accordance with the present invention.
Figure 2:
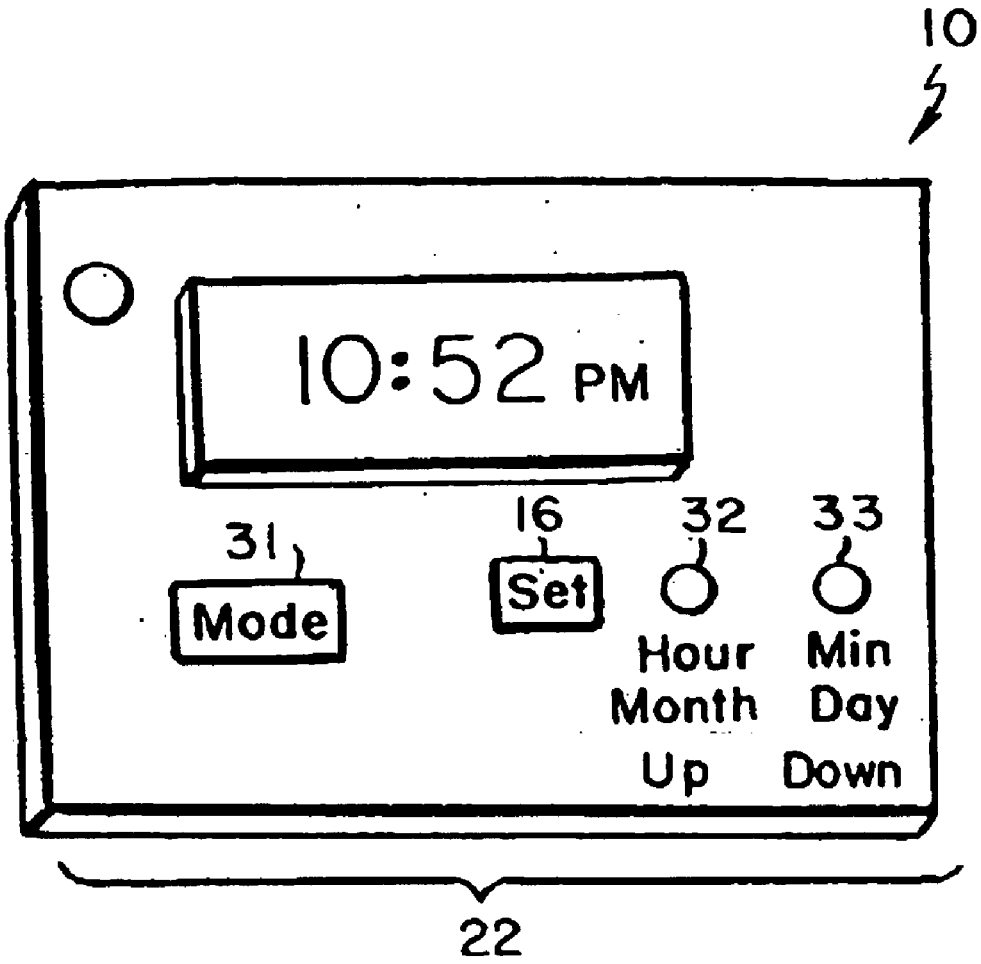
FIG. 2 shows an illustrative embodiment of a power outage indicator in accordance with the present invention.

Referring now to the various figures, there are shown in FIGS. 1 and 2, respectively, a block diagram and an illustrative embodiment of a power outage indicator 10 in accordance with the present invention. The power outage indicator 10 can detect power outage/failure and further can provide information about one or more power outages. The power outage indicator 10 includes a voltage input device 11, an auxiliary power supply 12, a voltage monitor and comparator 13, a microprocessor 14, one or more display devices 15, a reset mechanism 16, one or more input/output (I/O) devices 22, and one or more signaling devices 17.

Under normal operating conditions, which is to say, when there is no power outage, the power source 20 delivers power to the power outage indicator 10 through the voltage input device 11. Preferably, the power source 20 is a common utility grid that delivers a standard 120-volt alternating current (AC) power. More preferably, the voltage input device 11 comprises a pair of outlet prongs or connectors and a ground prong that are insertable in a common power outlet (CPO), e.g., a standard 120-volt outlet or receptacle, through which power can communicate from the power source 20 to the power outage indicator 10.

Because the voltage from the power source 20 exceeds the needs of the power outage indicator 10 and may otherwise destroy the various components of the power outage indicator 10, the voltage input device 11 can include a transformer 24 to step down or reduce the voltage from 120 volts to about 12 volts or less. Furthermore, the voltage input device 11 can include a rectifier 25 or an inverter 26 to convert AC to DC.

In the event of a power outage, the power outage indicator 10 includes an auxiliary power supply 12, e.g., a direct current (DC) battery, that is in parallel with the power source 20 to provide sufficient power to the various components of the power outage indicator 10. The auxiliary power supply 12 must be robust to provide power at least for a predetermined period of time, which is to say, for the duration of a power outage that can last for several seconds or several hours. Preferably, the predetermined period of time is at least two hours. More preferably, the predetermined period of time is at least six hours.

The voltage input device 11 communicates power from the utility grid 20 to a voltage monitor and comparator 13. The purpose of the voltage monitor and comparator 13 is to monitor incoming voltage from the voltage input device 11 in order to detect a decrease in the incoming voltage of sufficient magnitude to cause the voltage monitor and comparator 13 to switch circuits so that the power to the power outage indicator 10 comes from the auxiliary power supply 12 instead of from the utility grid 20. The voltage monitor and comparator 13 also monitors incoming voltage from the voltage input device 11 in order to detect an increase in the incoming voltage of sufficient magnitude to cause the voltage monitor and comparator 13 to switch circuits so that the power to the power outage indicator 10 again comes from voltage input device 11, i.e., the power source 20, instead of from the auxiliary power supply 12.

The microprocessor 14 comprises a central processing unit (CPU), random access memory (RAM) 18, read-only memory (ROM) 19, and a real-time clock 21. The ROM 19 includes a plurality of driver programs, i.e., algorithms that have been reduced to a machine- or computer-readable source code, that can be called and executed by the CPU. The RAM 18 includes erasable memory for the temporary, or volatile, storage of power outage data. For example, when incoming voltage from the voltage input device 11 decreases below a reference voltage, the voltage monitor and comparator 13 can send a first signal to the CPU to invoke, or call, a driver program from the ROM 19 that will record the date and time of the power outage, which is on the real-time clock 21, and that will store that date and time data in memory, e.g., RAM 18, or a memory cache (not shown). Similarly, when incoming voltage from the voltage input device 11 again increases above a reference voltage, the voltage monitor and comparator 13 can send a second signal to the CPU to call another driver program from memory, e.g., ROM 19, that will record the date and time of the power restoration; recall the previously stored date and time data of the power outage; perform an operation on these data sets to calculate the elapsed time between power outage and restoration; and store the result of this calculation in memory, e.g., RAM 18 or a memory cache. The ROM 19 includes additional drivers programs that respond to signals from other power outage indicator 10 components, e.g., the voltage monitor and comparator 13, the reset mechanism 16 and/or the I/O device(s) 22, which will be described below.

The microprocessor 14 communicates with one or more I/O devices 22 to enable a user to input data, e.g., the date, time or the mode of operation, for use by the microprocessor 14 and/or retrieve data from RAM 18, e.g., the number and duration of power outages, or to call a driver program to be run by the microprocessor 14. For example, one I/O device can include a mode selector 31 that, when enabled, sends a signal to the microprocessor 14 to call a driver program from ROM 19 that will allow the user to select an operating mode from a menu of modes that are stored in ROM 19, e.g., voltage monitor mode, current time mode, clock set mode, set alarm mode, store outage date/time mode, store power restored date/time mode, power outage (date and time) mode, power outage (duration) mode, and the like. Another I/O device 22 can include an hour/month/up scroll cursor input device 32, which allows a user to input the hour of the day when operating in a clock set mode or the month of the year when operating in the date set mode or scroll through a menu upwards; and a minute/day/down scroll cursor input device 33, which allows a user to input the minute of the hour when operating in a clock set mode or the day of the month when operating in the date set mode; or scroll through a menu downwards.

Yet another I/O device 22 that communicates with the microprocessor 14 can include a reset mechanism 16 that enables a user to reset input information when operating in, e.g., a clock set mode, date set mode, alarm set mode, and the like and/or to purge data stored in memory, e.g., RAM 18, when operating in, e.g., power outage (date and time) mode, power outage (duration) mode, and the like. Accordingly, if, for example, the user makes a mistake when entering the number of minute past the hour when in the clock set mode, the user can activate the reset mechanism 16, which will send a signal to the CPU of the microprocessor 14 invoking a driver program from memory, e.g., ROM 19, that can erase the data stored in the minute memory of the real-time clock 21, thus allowing the user to input the correct number of minutes past the hour.

Preferably, the power outage indicator 10 of the present invention includes a display device 15, e.g., a liquid crystal display (LCD) screen, a light emitting diode (LED) screen, and the like, for displaying data for any mode of operation. For example, normally, during the power monitor mode, the display device 15 will output the current time, e.g., in hours, minutes with an indication whether AM or PM. Similarly, when in a power outage (date and time mode), the display device 15 can output the date, e.g., by month and day, and/or time, e.g., by hour and minute, of a power outage.

The power outage indicator 10 also can include a battery recharger 23 that is in communication with the voltage input device 11 and with the auxiliary power supply 12. The battery recharger 23 makes it possible to recharge the auxiliary power supply 12 by storing power from the utility grid 20 in the auxiliary power supply 12 when power to the device 10 is being provided by the utility power grid 20.

The power outage indicator 10 also includes a signaling device 15 to alert the user that there has been a power outage/failure. Preferably the signaling device 15 is a visual, e.g., a strobe, flashing, e.g., red, light, steady, e.g., red, light, light emitting diode message, or liquid crystal display message and/or an audible device, e.g., a device that produces a low frequency beeping or chirping noise.

Figure 3:
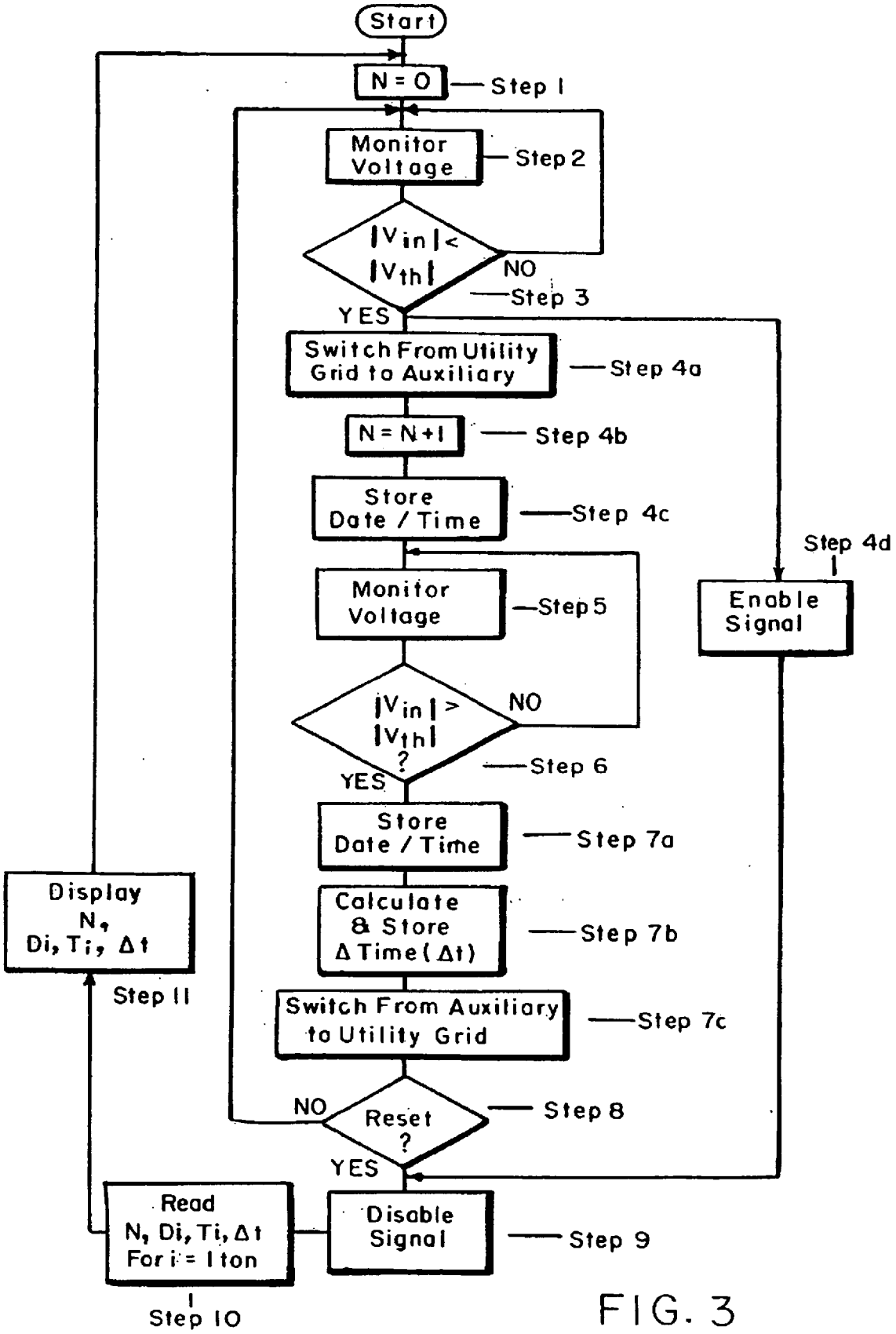
FIG. 3 shows a flow chart of an illustrative embodiment of how a power outage indicator works in accordance with the present invention.

Having described an embodiment of a power outage device 10, we will now describe how the device 10 operates and the inter-relationship between the components of the device 10. Referring to FIG. 3, there is shown a block diagram of the operation of a power outage device 10 in accordance with another embodiment of the present invention. The device 10 is powered by communicating the device with a power source 20, e.g., a utility grid. Preferably, the point of communication is a CPO, e.g., a standard 120-volt outlet or receptacle.

When the device 10 is connected for the first time to a power source 20 or when the device 10 has not been connected to a power source 20 for a period of time, and before the device 10 can be used to monitor power outages and failures it will be necessary to set the real-time clock 21. The real-time clock 21 can be set by selecting the time set mode after depressing the mode select device 31 and then entering the date and time. When the mode select device 31 is depressed, a signal is sent to the CPU, causing the CPU to invoke a mode menu driver program that is stored in memory, e.g., ROM 19. The mode menu driver program is executed by the CPU, causing the operating modes of the mode menu to be sent to the device 10 for display one at a time on the display screen 15. Users can scroll through the operating modes of the mode menu using the up and down devices 32 and 33.

After the user identifies the desired operating mode, e.g., the clock set mode, the user can double press the mode select device 31, which sends a signal to the CPU. This signal causes the mode menu driver program to shutdown and then invokes a clock set driver program that is stored in memory, e.g., ROM 19. The time set driver program is executed by the CPU, causing a month menu, day menu, and year menu to be sent to the device 10 for display successively on the display screen 15.

The clock set driver program takes the user through the clock set algorithm interactively by prompting the user to select the current month, day of the month, and year from corresponding month, day, and year menus using the up and down buttons 32 and 33 to scroll through the respective menus.

For example, the CPU can communicate a current month menu to the display device 15. After the user identifies the current month, the user can double press the mode select device 31, which sends a signal to the CPU to store the data in a real-time clock database and then transmit the days of the month menu to the display device 15. After the user identifies the current day of the month, the user can double press the mode select device 31, which sends a signal to the CPU to store the data in the real-time clock database and the transmit the year menu to the display device 15. After the user identifies the current calendar year, the user can double press the mode select device 31, which sends a signal to the CPU to store the data in the real-time clock database and transmit the hour of the day menu to the display device 15. After the user identifies the current hour of the day, the user can double press the mode select device 31, which sends a signal to the CPU to store the data in the real-time clock database and finally transmit the minute of the hour menu to the display device 15. After the user identifies the current minute of the hour, the user can double press the mode select device 31, which sends a signal to the CPU to store the data in a real-time clock database. At this point, the real-time clock 21 has been set to the current time and the clock set mode driver program is shut down. Preferably, the real-time clock 21 of the present invention can include features that account for daylight savings time and leap years.

Once the real-time clock 21 has been set, the device 10 can be enabled to monitor power outage/failure. To enable the voltage monitor mode, users again can depress the mode select device 31. When the mode select device 31 is depressed, a signal is sent to the CPU, causing the CPU to invoke a mode menu driver program that is stored in memory, e.g., ROM 19. The mode menu drive program is executed by the CPU, causing the modes of the mode menu to be sent to the display device 15 for display one at a time on the display screen 15. Users can scroll through the modes of the mode menu using the up and down devices 32 and 33.

After the user identifies the desired operation mode, i.e., voltage monitor mode, the user can double press the mode select device 31, which sends a signal to the CPU. This signal causes the mode menu driver program to shutdown and then invokes a voltage monitor driver program that is stored in memory, e.g., ROM 19. The voltage monitor driver program is executed by the CPU, which causes a power outage counter to be set to zero, e.g., N=0, STEP 1 and enables the voltage monitor and comparator 13 to monitor voltage delivered to the voltage input device 11 STEP 2.

The voltage monitor and comparator 13 monitors incoming voltage $V_{in}$ and compares the magnitude of the incoming voltage $V_{in}$ with a reference or threshold voltage $V_{th}$ STEP 3. As long as the incoming voltage $V_{in}$ exceeds the threshold voltage $V_{th}$, the device 10 continues to monitor the incoming voltage $V_{in}$ STEP 2 and voltage from the power source 20 powers the microprocessor 14 and the rest of the device 10. However, when the incoming voltage $V_{in}$ dips below the threshold voltage $V_{th}$, the voltage monitor and comparator 13 sends one or more power outage signals, e.g., to a switching device (not shown). The one or more power outage signals instantaneously switches the source of power to the device 10 from the utility grid 20 to the auxiliary power supply 12 STEP 4*a* in a manner that is well known to the art.

The one or more signals from the voltage monitor and comparator 13 further causes the CPU to increase the power outage event counter by one, e.g., N=N+1, STEP 4*b* and invokes a store outage date/time driver program STEP 4*b* that is executed by the CPU. The invoked store outage date/time driver program instantaneously reads the current date and time of the real-time clock 21. These data, i.e., power out date and time, are then stored in memory, e.g., ROM 18, STEP 4*c*. The one or more signals also can enable the at least one signaling device 17 STEP 4*d* to provide a visual and/or audible signal to alert the user that there has been a power outage.

The voltage monitor and comparator 13 continues to monitor incoming voltage $V_{in}$ and compares the magnitude of the incoming voltage $V_{in}$ with the threshold voltage $V_{th}$ STEP 5. As long as the incoming voltage $V_{in}$ is less than the threshold voltage $V_{th}$, voltage from the auxiliary power supply 12 powers the microprocessor 14 and the rest of the device 10. However, when the incoming voltage $V_{in}$ exceeds the threshold voltage $V_{th}$, the voltage monitor and comparator 13 sends one or more power outage signals, e.g., to the switching device STEP 6. The one or more power outage signals instantaneously switches the source of power to the device 10 back to the utility grid 20 STEP 7*c*.

The one or more signals from the voltage monitor and comparator 13 also invokes a store power restored time driver program that is stored in memory, e.g., ROM 19. The invoked store power restored date/time driver program instantaneously reads the current date and time of the real-time clock 21. These data, i.e., power restored date and time, are then stored in memory, e.g., RAM 18, or, alternatively, in a memory cache STEP 7*a*. The store power restored time driver program also can calculate the amount of time between the power outage and power restoration ($\Delta t$) STEP 7*b* and, further, can store that data and the outage event counter number N in memory, e.g., RAM 18.

Once the device 10 has been through a power outage-power restoration cycle, the device 10 can return to the monitor voltage mode STEP 2 until the user disables the monitor voltage mode STEP 8. To disable the voltage monitor mode, the user can depress the mode selection device 31, which produces a scrollable menu of device operating modes that has been described previously. For example, the user can select a date and time of power outage mode and/or a number and duration of power outages mode. Alternatively, the user can depress a reset mechanism 16, which will automatically disable the at least one signaling device 17 STEP 9 and terminate the voltage monitor mode.

After the user identifies the desired operation mode, e.g., the power outage (date and time) mode or the power outage (number and duration) mode, the user can double press the mode select device 31, which sends a signal to the CPU. This signal causes the mode menu driver program to shutdown and also invokes a power outage (date and time) driver program or a power outage (number and duration) driver program that are stored in memory, e.g., ROM 19. The power outage (date and time) or power outage (number and duration) driver program is then executed by the CPU.

The power outage (date and time) driver program, for example, causes the CPU to read the data, i.e., time $T_i$ and date $D_i$ for each power outage event i=1, . . . , N, that were stored in memory, e.g., RAM 18, STEP 10 and display that data on the display device 15 STEP 11 on demand. Similarly, the power outage (number and duration) driver program causes the CPU to read the data, i.e., number N and duration of each power outage $\Delta t_i$ for i=1, . . . . N, that were stored in memory, e.g., RAM 18, STEP 10 and display the data on the display device 15 STEP 11 on demand.

Although preferred embodiments of the invention have been described using specific terms, such descriptions are for illustrative purposes only, and it is to be understood that changes and variations may be made without departing from the spirit or scope of the following claims.

For example, the power outage device 10 also can include an alarm clock feature that will allow the user to input an alarm on time through a set alarm mode. After the user selects the set alarm mode, a set alarm driver program that is stored in memory, e.g., ROM 19, can be invoked. Preferably, the set alarm driver program can lead the user through the same sequence of steps and entries as previously described for setting the real-time clock 21. Once the alarm time is set, e.g., after double pressing the mode selection button 31, the device 10 can operate in an alarm clock mode. When the time on the real-time clock 21 reaches the alarm set time, the CPU sends a signal enabling at least one of the signaling devices 17. The signaling device 17 continues to provide a visual or audible signal until the user enables the reset mechanism 16, which causes the device 10 to return to the default mode, i.e., current time mode. Alternatively, the signaling device 17 can be programmed in advance to stop after a certain period of time.

Although the invention has been described having a utility grid as a power source, the invention is not to be construed as being so limited. Those skilled in the art can appreciate that the power source 20 can include a fuel cell, flywheel assembly, induction-type motor, diesel motor, energy storage device, and the like.

What is claimed is:

1. A power outage detection device for alerting users of a number, time, and duration of one or more power outages, the device comprising:

a voltage input receiver for receiving voltage from a power source;

a voltage monitor for monitoring a reference voltage that is received from the power source;

a change in voltage detector for detecting a change in the reference voltage, wherein the change is determined by comparing the reference voltage with a threshold voltage and the change is of sufficient duration to constitute a power outage;

a microprocessor having a central processing unit;

a programmable real-time clock that is in communication with the microprocessor to provide current date and time data;

one or more input/output devices for communicating data to and from the microprocessor, wherein the one or more input/output devices comprises at least one of:

a signal that is in communication with the microprocessor to indicate that there has been one or more power outages;

a display that is in communication with the microprocessor to display data on demand;

an auxiliary energy power supply that provides power to the device during the one or more power outages until the reference voltage exceeds the threshold voltage; and a switching device that is in communication with the voltage monitor, the change in voltage detector, the voltage input receiver, and the auxiliary power supply;

wherein the microprocessor comprises a plurality of memory that includes read only memory for storing one or more microprocessor driver programs and random access memory for storing power outage data for one or more power outages;

wherein one of the one or more driver programs stores first current date and time data in the random access memory after the reference voltage dips below the threshold voltage; stores second current date and time data in said random access memory after said reference voltage recovers and exceeds said threshold voltage; calculates a time difference between the second current date and time data and the first current date and time data; stores said time difference in said random access memory; and enables the signal; and wherein when the reference voltage exceeds a threshold voltage the switching device delivers power to the device voltage input receiver, and when the reference voltage is less than the threshold voltage, the switching device delivers power to the device from the auxiliary power supply.

2. The power outage device as recited in claim 1, wherein the voltage input receiver is a common power outlet adapter and the power source is a utility grid.

3. The power outage device as recited in claim 1, wherein the voltage input receiver comprises:

a transformer to step down the voltage received from the power source;

an inverter to convert alternating current voltage received from the power source to direct current voltage; and a rectifier to rectify the voltage received from the power source.

4. The power outage device as recited in claim 1, wherein the change in voltage detector is a comparator.

5. The power outage device as recited in claim 1, wherein the signal is at least one of a visual indicator and an audible indicator.

6. The power outage device as recited in claim 5, wherein the visual indicator is selected from a group comprising a steady light, a flashing light, a strobe, a liquid crystal display message and a light emitting diode message.

7. The power outage device as recited in claim 5, wherein the audible indicator is selected from a group comprising a chirper and a beeper.

8. The power outage device as recited in claim 1, wherein the one or more input/output devices for communicating data to and from the microprocessor includes at least one of:

a reset mechanism;

a mode selection button to select a mode of operation for the device; and a set of scroll buttons to enable a user to move up and down a menu.

9. The power outage device as recited in claim 1, wherein the display is selected from a group comprising a light emitting diode and a liquid crystal diode.

10. The power outage device as recited in claim 1, wherein the auxiliary power supply is a rechargeable battery.

11. The power outage device as recited in claim 1, wherein the device further comprises a recharger for recharging the auxiliary power supply with power from the power supply.

12. The power outage device as recited in claim 1, wherein the device further comprises an alarm clock feature that enables the device to be used as an alarm clock.

13. A power outage detection device for alerting users of a number, time, and duration of one or more power outages, the device comprising:

means for receiving voltage input from a power source;

means for monitoring a reference voltage from the power source;

means for detecting a change in the reference voltage, wherein the change is determined by comparing the reference voltage with a threshold voltage and the change is of sufficient duration to constitute a power outage;

a microprocessor;

a real-time clock that is in communication with the microprocessor to provide current date and time data;

signaling means that is in communication with the microprocessor to indicate that there has been one or more power outages;

an auxiliary energy power supply that provides power to the device during the one or more power outages until the reference voltage exceeds the threshold voltage;

display means that are in communication with the microprocessor to provide data on the one or more power outages on demand; and switching means that is in communication with the means for monitoring a reference voltage, the means for detecting a change in voltage, the means for receiving voltage input, and the auxiliary power supply;

wherein the microprocessor comprises a plurality of memory that includes read only memory for storing one or more microprocessor driver programs and random access memory for storing power outage data for one or more power outages; and wherein one of said one or more driver programs stores first current date and time data in the random access memory after the reference voltage dips below the threshold voltage; stores second current date and time data in said random access memory after said reference voltage recovers and exceeds said threshold voltage; calculates a time difference between the second current date and time data and the first current date and time data; stores said time difference in said random access memory; and enables the signaling device.

* * * * *